United States Patent [19]

Taylor

[11] Patent Number: 5,060,946

[45] Date of Patent: Oct. 29, 1991

[54] VOLLEYBALL PRACTICE DEVICE

[76] Inventor: James E. Taylor, R. 8 Box 42, Frankfort, Ind. 46041

[21] Appl. No.: 593,058

[22] Filed: Oct. 5, 1999

[51] Int. Cl.[5] ..... A63B 69/00

[52] U.S. Cl. ..... 273/411; 273/58 C; 273/413

[58] Field of Search ..... 273/411, 413, 58 C, 273/65 R, 65 A

[56] References Cited

U.S. PATENT DOCUMENTS

| | | | |
|---|---|---|---|
| 4,022,476 | 5/1977 | Barton | 273/58 C X |
| 4,865,319 | 9/1989 | Drazinakis | 273/413 X |
| 4,881,742 | 11/1989 | Hargreave | 273/413 |
| 4,887,821 | 12/1989 | Greene et al. | 273/411 |

*Primary Examiner*—William H. Grieb

*Attorney, Agent, or Firm*—Thomas J. Dodd

[57] ABSTRACT

A training device for volleyball players which includes a generally L-shaped frame which is vertically adjustable. A volleyball is connected to the terminal end of the frame via a tether cord arrangement.

4 Claims, 2 Drawing Sheets

VOLLEYBALL PRACTICE DEVICE

FIELD OF THE INVENTION

This invention relates to sports practice devices and has special application to volleyball training device.

BACKGROUND OF THE INVENTION

Volleyball has recently grown in popularity as both a spectator and participant sport. Until recently, the only practice devices available for the sport were of the type shown in U.S. Pat. No. 3,897,950 and included elevations which held a ball above the net to allow players to practice hitting technique. Such devices require the balls to be constantly retrieved and reset in the elevations after each practice hit.

SUMMARY OF THE INVENTION

The volleyball practice device of this invention includes a frame which has a volleyball connected to a terminal end thereof by a rotatable tether cord. The device allows the ball to be hit over and over without retrieval and resetting. The frame may be vertically adjustable so that the ball is at the proper height to practice a variety of shots, sets, blocks and serves. Because the ball is connected to the frame, retrieval is unnecessary which allows greater use of practice time and also allows players to practice alone or in small groups.

Accordingly, it is an object of this invention to provide for a novel volleyball practice device.

Another object is to provide for a volleyball practice device which eliminates ball retrieval and reset to maximize practice time.

Another object is to provide a durable and economical volleyball practice device which allows a player to practice a variety of different shots.

Still another object is to provide a height adjustable volleyball practice device which allows the device to be adapted to accommodate varying net heights and shots.

Other objects will become apparent upon a reading of the following description.

BRIEF DESCRIPTION OF THE DRAWINGS

A preffered embodiment of the invention has been depicted for illustrative purposes wherein.

DESCRIPTION OF THE PREFERRED EMBODIMENT

Figure 1:
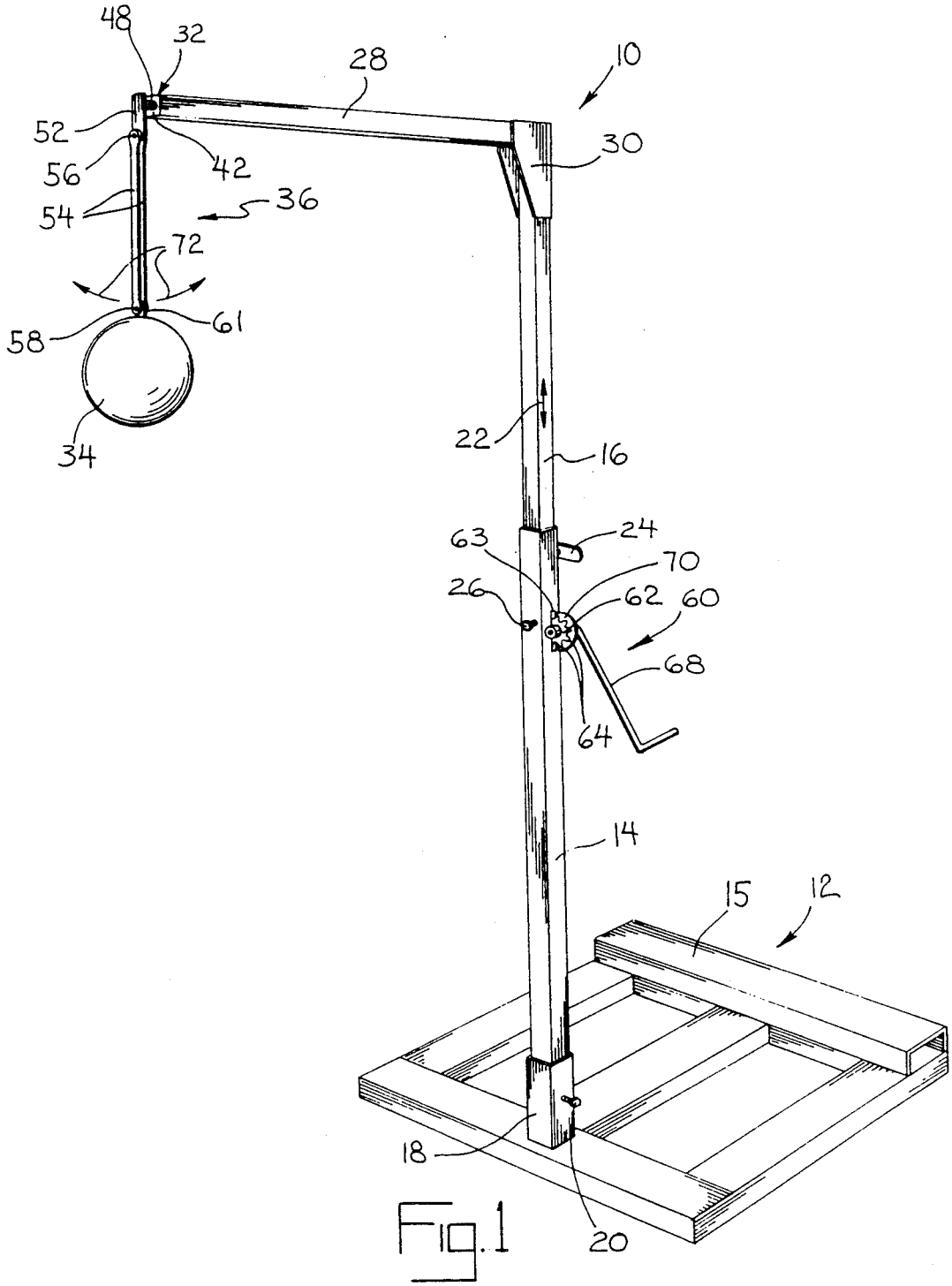
FIG. 1 is a perspective view of the volleyball practice device of this invention.
Figure 2:
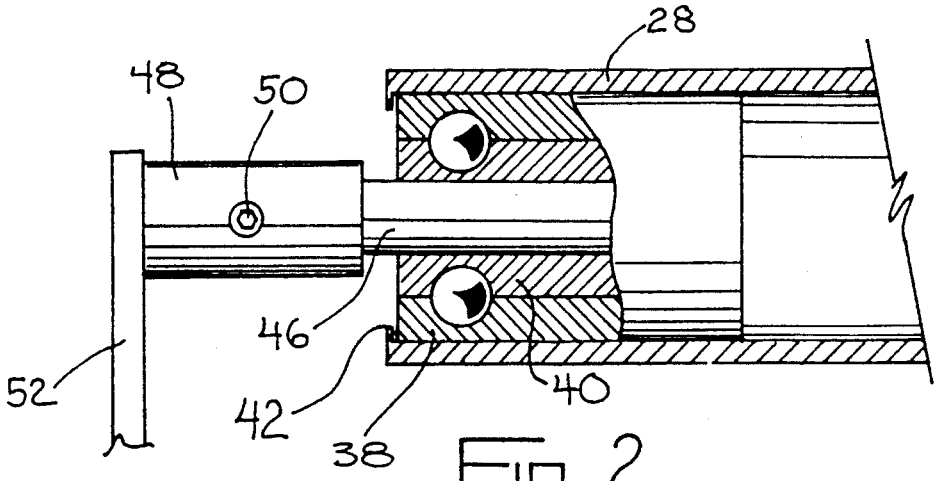
FIG. 2 is a fragmented elevation view of the tethering device with portions shown in section for illustrative purposes.
Figure 3:
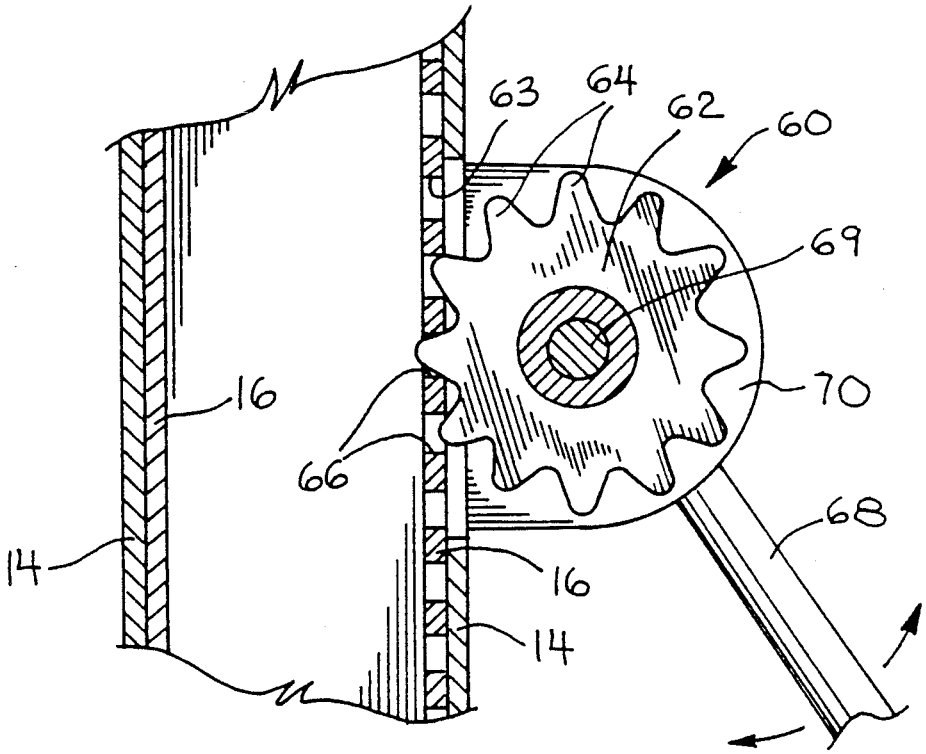
FIG. 3 is a fragmented sectional view of the height adjustment device.

The preferred embodiment herein described is not intended to be exhaustive or to limit the invention to the precise form disclosed. It is chosen and described to explain the principles of the invention and its application and practical use so others skilled in the art might follow its teachings.

As shown in the drawings, volleyball practice device 10 includes a support frame 12 which has a base 15, and first and second telescoping tubular poles 14 and 16. Wheels (not shown) may be secured to base 15 to allow device 10 to be rolled from place to place.

Pole 14 is connected to an upright support tube 18 of base 15 such as by fastener 20. Pole 16 slides telescopically within pole 14 to allow vertical height adjustment of device 10 according to arrow 22 of FIG. 1. Poles 14, 16 are secured against relative movement by fasteners 24, 26 when it is desired to use the device 10 for practice.

A generally horizontal tubular support pole 28 is connected to pole 16 such as by welding to connect bracket 30. Pole 28 is substantially hollow and includes a terminal end 32.

Volleyball 24 is suspended from pole end 32 by a tethering device generally designated by reference numeral 36. Tether 36 includes a bearing receiver 38 and double ball bearing 40 fitted inside pole 28 as shown. Snap ring 42 covers pole end 32 to prevent the bearing 40 from accidentally dislodging from within the pole 28. A shaft 46 is rotatably carried in bearing 40 and arm 48 is secured to the exposed end 47 of the shaft such as by fasteners 50. Hanger bracket 52 is connected to arm 48 as by welding.

Tether rope 54 which may be of any acceptable material, such as leather, rubber, plastic, cord, bungee cord or other connecting material, is connected to hanger bracket 52 by fastener 56. Rope 54 is connected to volleyball 34 in similar fashion by fastener 58 which extends through a projecting ear 61 of the ball. Alternatively, the ball 34 may be carried in a harness (not shown) connected to bracket 52.

Height adjustment device 60 includes a sprocket 62 whose teeth 54 extend through hole 63 in pole 14 and mesh with holes 66 in pole 16. Sprocket 62 is connected via a conventional rod and bushing 69 to crank handle 68 which is connected to pole 16 by bracket 70.

In use, device 10 is first adjusted to the proper height for the exercise to be performed by adjustment device 60 as above described. Volleyball players (not shown) may then practice the desired exercise by striking ball 34, which due to its tethered connection to pole 28 rotates in a 360° fashion about the bearing 40 in the direction of arrows 72. Due to this tethered connection, ball 34 remains connected to device 10 removing the necessity of a person retrieving and/or resetting the ball after each practice hit.

It is understood that the above description does not limit the invention to the above-given details but may be modified within the scope of the following claims.

I claim:

1. In a volleyball practice device including a base, as upright pole connected to and extending upwardly from the base, and a generally horizontal pole connected to said upright pole, the improvement comprising a tether means for rotatably securing a volleyball to said horizontal pole, wherein said volleyball remains rotatably attached to said horizontal pole after being struck, said tether means including a bearing connected to said horizontal pole at a terminal end thereof, said tether means including an arm rotatably connected to said bearing, and a flexible tether strap suspended from said arm, said tether strap carrying said volleyball.

2. The volleyball practice device of claim 1 wherein said upright pole includes first and second poles telescopically connected, and means for shifting said first pole relative to the second pole, wherein height of said device may be adjusted.

3. The volleyball practice device of claim 1 and means for securing said bearing inside horizontal pole.

4. The volleyball practice device of claim 1 and a hanger bracket connected between said tether strap and said arm, said tether strap including first and second strap parts connected to said hanger bracket, and connecting means associated with said volleyball, said connecting means for accepting said first and second tether straps.

* * * * *